US009083090B2

(12) United States Patent
Wu et al.

(10) Patent No.: US 9,083,090 B2
(45) Date of Patent: Jul. 14, 2015

(54) PLUG-IN WIRE CONNECTION TERMINAL STRUCTURE

(71) Applicant: SWITCHLAB INC., New Taipei (TW)

(72) Inventors: Chih-Yuan Wu, New Taipei (TW); Ming-Hung Lien, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 14/473,002

(22) Filed: Aug. 29, 2014

(65) Prior Publication Data

US 2014/0370738 A1 Dec. 18, 2014

Related U.S. Application Data

(63) Continuation of application No. 13/644,449, filed on Oct. 4, 2012, now Pat. No. 8,851,920.

(51) Int. Cl.

| | |
|---|---|
| ***H01R 4/24*** | (2006.01) |
| ***H01R 9/16*** | (2006.01) |
| ***H01R 4/48*** | (2006.01) |
| ***H01R 13/18*** | (2006.01) |

(52) U.S. Cl.

CPC ..... *H01R 9/16* (2013.01); *H01R 4/4827* (2013.01); *H01R 13/18* (2013.01)

(58) Field of Classification Search

USPC ..... 439/441, 834, 835
IPC ..... H01R 4/4818,4/4827, 4/4836, 2103/00, H01R 3/193
See application file for complete search history.

(56) References Cited

U.S. PATENT DOCUMENTS

| | | | | |
|---|---|---|---|---|
| 7,762,834 | B2 * | 7/2010 | Schrader | 439/441 |
| 8,113,858 | B1 * | 2/2012 | Chiang | 439/188 |
| 8,251,738 | B2 * | 8/2012 | Heckert et al. | 439/441 |
| 8,262,422 | B1 * | 9/2012 | Chiang | 439/835 |

* cited by examiner

*Primary Examiner* — Hien Vu
(74) *Attorney, Agent, or Firm* — Rosenberg, Klein & Lee

(57) ABSTRACT

A plug-in wire connection terminal structure includes a main body having a receiving space. The receiving space is formed with an arched guide slot. A holding plate has a receiving section. Lateral sides of the receiving section are respectively formed with a wire entrance and a conductive contact section formed with a socket. An annular wall of the socket is formed a slit. A small-diameter fitting section is disposed at the conductive contact section. A collar member is fitted on the fitting section. A connection section is disposed on the receiving section. A leaf spring has a bight section received in the arched guide slot. One end of the leaf spring is formed with a connected section latched with the connection section. The other end of the leaf spring is formed with an abutment end obliquely extending the receiving section.

28 Claims, 7 Drawing Sheets

PLUG-IN WIRE CONNECTION TERMINAL STRUCTURE

REFERENCE TO RELATED APPLICATION

This application is being filed as a Continuation application of Ser. No. 13/644,449, filed Oct. 4, 2012, currently pending.

BACKGROUND OF THE INVENTION

1. Field of the Invention

The present invention relates generally to a plug-in wire connection terminal structure, and more particularly to a plug-in wire connection terminal structure, which has simplified structure and is easy to assemble. Moreover, the plug-in wire connection terminal structure has excellent structural strength and is able to provide excellent elastic holding effect.

2. Description of the Related Art

There are various conventional large-current connectors. For example, Chinese Invention Patent Publication No. CN 101595603A discloses an electrical wire connection terminal. The terminal has an insulation housing, a metal piece disposed in the housing and a leaf spring disposed in the housing. The metal piece is made of high-conductivity metal material and the leaf spring has highly stable elasticity. The metal piece is assembled with the leaf spring to form a conduction circuit for conducting large current. The metal piece has a connection plate. Two sides of the connection plate are bent to form a latch arm and a contact arm respectively. A plug section and a fixing section respectively extend from two end sections of the contact arm. A fixing section corresponding to the plug section extends from one side of the latch arm opposite to the plug section. A locking protrusion section is disposed on the fixing section and stopper sections are disposed on two sides of the fixing section. The middle section of the leaf spring is formed with a bight section. One side of the bight section is formed with an outward protruding latch section, which is correspondingly latched with the fixing section of the metal piece. A support arm further extends from the bight section for more securely latching with the metal piece. The support arm is formed with a hollow. An electrical conductor to be connected can be passed through the hollow. Then the fixing section of the metal piece is fitted and latched with the rear end of the support arm. Moreover, the latch section is formed with a hole. The other side of the leaf spring is formed with a clamping arm. The end of the clamping arm extends through the hollow of the support arm to abut against the inner face of the contact arm so as to conveniently connect with the electrical conductor to be connected. When assembled, the latch section of the leaf spring and the rear end of the contact arm are inserted with the fixing section of the metal piece. The latch section of the leaf spring is inserted between the fixing section of the metal piece and the stopper sections. The locking protrusion section is inserted into the corresponding hole, whereby the leaf spring can be securely connected with the metal piece with the end section of the clamping arm abutting against the contact arm.

In practice, the insulation housing is formed with a conductor inlet and an operation hole corresponding to the hollow of the leaf spring. The operation hole is positioned above the conductor inlet. An electrical conductor can extend into the conductor inlet to upward push the clamping arm, whereby the end section of the clamping arm can obliquely abut against the electrical conductor to hold and prevent the electrical conductor from being reversely pulled out. Accordingly, the electrical conductor can keep in tight electrical contact with the contact arm of the metal piece. The plug section can be electrically plugged into an external corresponding socket. An operation tool (such as a screwdriver) can extend into the operation hole to shift the clamping arm and separate the end section of the clamping arm from the electrical conductor. Under such circumstance, the electrical conductor can be reversely pulled out of the conductor inlet and separated from the metal piece.

In practice, the above structure has the following shortcomings:

1. The leaf spring and the metal piece are designed with complicated configuration and structure so that the development and processing cost is higher. This will affect the competitive ability of the product due to higher price.
2. The leaf spring needs the support arm to be wound on and fixed with the metal piece at the same time for assembling therewith. In addition, the clamping arm needs to extend from the winding section of the support arm into abutment against the contact arm of the metal piece and further needs to pass through the hollow. Therefore, total length of the leaf spring or the metal piece is longer and it is necessary to use and cut off a mass of metal material to manufacture the leaf spring. As a result, the manufacturing cost can be hardly lowered as a whole. U.S. Pat. Nos. 8,262,422B1, 6,336,824B1 and 7,762,834B2 have similar shortcomings.
3. The support arm of the leaf spring is formed with a large hollow so that a mass of waste material is produced during the processing procedure. This obviously affects the strength of the support arm and fails to meet the principle of economic efficiency and structural design. U.S. Pat. No. 5,454,730 has similar problems.

There also are various plug-in wire connection terminal structures. For example, Chinese Utility Patent Publication No. CN 201112705Y discloses a plug-in wire connection terminal. The terminal includes a pin-shaped plug-in terminal (metal plug-in terminal) and a pin-shaped socket member (metal connection socket member). The pin-shaped socket member has a through hole for receiving the pin-shaped plug-in terminal. At least one split is formed on the annular wall of the pin-shaped socket member, whereby the through hole is expandable. In addition, the outer wall of the middle section of the pin-shaped socket member is formed with an annular recessed section for a spring steel collar to fit around the pin-shaped socket member. By means of the elasticity of the spring steel collar, the through hole is fully elastically bound to have a sufficient structural strength. Accordingly, it is ensured that the pin-shaped plug-in terminal is lastingly tightly enclosed in the pin-shaped socket member.

Chinese Utility Patent Publication No. CN 201038406Y discloses a power connector terminal structure including a female terminal in which a male terminal can be electrically plugged. The female terminal is composed of a main body and an outer housing. The main body is formed with a locating section, which can be fixedly disposed in a preset insulation seat body. A welding section is disposed on one side of the locating section. The welding section can extend through the insulation seat body to outer side thereof. The other side of the locating section distal from the welding section is formed with a mating section. The mating section has at least one axially extending split. In addition, an annular groove is formed on outer circumference of the mating section for the outer housing to fit thereon. A restriction section is disposed on one side of one end of the outer housing. The restriction section can be inserted in the split to provide a fixing effect for preventing the outer housing from axially rotating on the surface of the annular groove. Also, the outer housing permits the mating section to elastically expand without over-stretching. Accordingly, a true locating effect is achieved to keep a good electrical connection.

However, in the above conventional structures, the outer circumference of the middle section of the pin-shaped socket member (or the female terminal) is formed with an annular recess (annular groove) for fitting a spring steel collar (outer housing) around the outer circumference. In practice, the conventional structures have the following shortcomings:

1. The outer circumference of the middle section of the pin-shaped socket member (or the female terminal) is formed with the annular recess (annular groove). In this case, the pin-shaped socket member (or the female terminal) has a complicated configuration and structure. This will increase difficulty in forming and processing the pin-shaped socket member (or the female terminal). As a result, the manufacturing cost is increased and the competitive ability is lowered due to higher price.
2. In design, it must be ensured that the inner circumference of the spring steel collar or the outer housing is snugly fitted on the annular recess or annular groove in dimension. Otherwise, in the case of unfitness, the holding force will be insufficient (the size of the inner circumference of the spring steel collar or the outer housing is too large) or the elastic expansion of the pin-shaped socket member or female terminal is insufficient (the size of the inner circumference of the spring steel collar or the outer housing is too small). Such requirement in dimension precision will also cause increase of manufacturing cost.
3. The spring steel collar (or the outer housing) is a partially split structure with a C-shaped cross section. When assembled, the split is directly fitted onto the annular recess (or the annular groove). In such assembling process, in the case that the spring steel collar (or the outer housing) itself has weaker structural strength, it is easier to expand the spring steel collar (or the outer housing) to overpass the outer circumference of the pin-shaped socket member (or female terminal) with larger outer diameter. In this case, the spring steel collar (or the outer housing) can be easily assembled on the annular recess (or annular groove). However, such spring steel collar (or the outer housing) will inevitably have poorer elasticity so that the holding force applied to the pin-shaped socket member (or the female terminal) is easy to deteriorate. Reversely, in the case that the spring steel collar (or the outer housing) has greater structural strength, then the spring steel collar (or the outer housing) will have better structural elasticity. However, under such circumstance, it will be uneasy to assemble the spring steel collar (or the outer housing) on the annular recess (or annular groove). Accordingly, in consideration of structural design, it is hard to decide whether the difficulty in assembling should be lowered or the holding force should be increased.

It is therefore tried by the applicant to provide a plug-in wire connection terminal structure to overcome the shortcomings existing in the conventional technique.

SUMMARY OF THE INVENTION

It is therefore a primary object of the present invention to provide a plug-in wire connection terminal structure, which has simplified structure and is easy to assemble. Therefore, the development and assembling cost for the plug-in wire connection terminal structure is lowered.

It is a further object of the present invention to provide the above plug-in wire connection terminal structure, in which the components are easy to process and only little waste material is produced during the processing procedure. Therefore, the processing and material cost is lowered.

It is still a further object of the present invention to provide the above plug-in wire connection terminal structure, which can provide better and more stable elastic holding effect to keep the terminal structure in good contact with another terminal mated with the terminal structure.

To achieve the above and other objects, the plug-in wire connection terminal structure of the present invention includes: a main body having an internal receiving space, lateral sides of the receiving space being respectively formed with an arched guide slot in communication with the receiving space and a stopper block; a holding plate having a receiving section in the middle, the receiving section being positioned in the receiving space of the main body, lateral sides of the receiving section being respectively formed with a wire entrance and a conductive contact section in which an external member can be conductively plugged, a connection section being further disposed on the receiving section, the connection section extending to the arched guide slot; and a leaf spring having a bight section in the middle, the bight section being received in the arched guide slot of the main body, a connected section being disposed at one end of the bight section, the connected section being detachably latched with (or hooked with) the connection section of the holding plate, the stopper block being cooperatively engaged with the connected section, whereby the holding plate and the leaf spring are securely connected with each other without easy detachment, an abutment end being disposed at the other end of the bight section, when the leaf spring is assembled with the main body, the abutment end obliquely extending from the wire entrance of the holding plate to the receiving section, the abutment end having such a length that the abutment end is just kept in the receiving section inside a guide edge.

In the above plug-in wire connection terminal structure, a conductive contact section extends from the holding plate. The conductive contact section is formed with a socket. An annular wall of the socket is formed with at least one slit. A fitting section is disposed at one end of the conductive contact section, which end is distal from the receiving section. The fitting section extends from outer circumference of the end of the conductive contact section. A collar section of a collar member is correspondingly fitted on the fitting section and secured to the fitting section.

The present invention can be best understood through the following description and accompanying drawings, wherein:

DETAILED DESCRIPTION OF THE PREFERRED EMBODIMENTS

Figure 1:
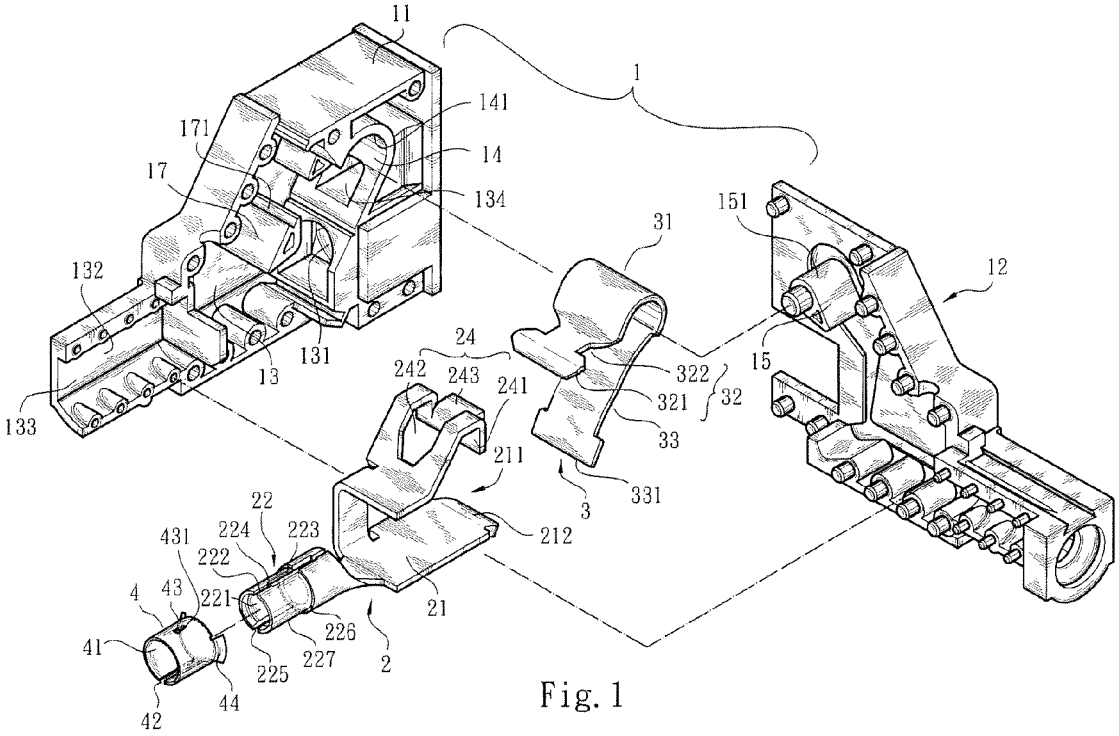
FIG. 1 is a perspective exploded view of a first embodiment of the present invention.
Figure 2:
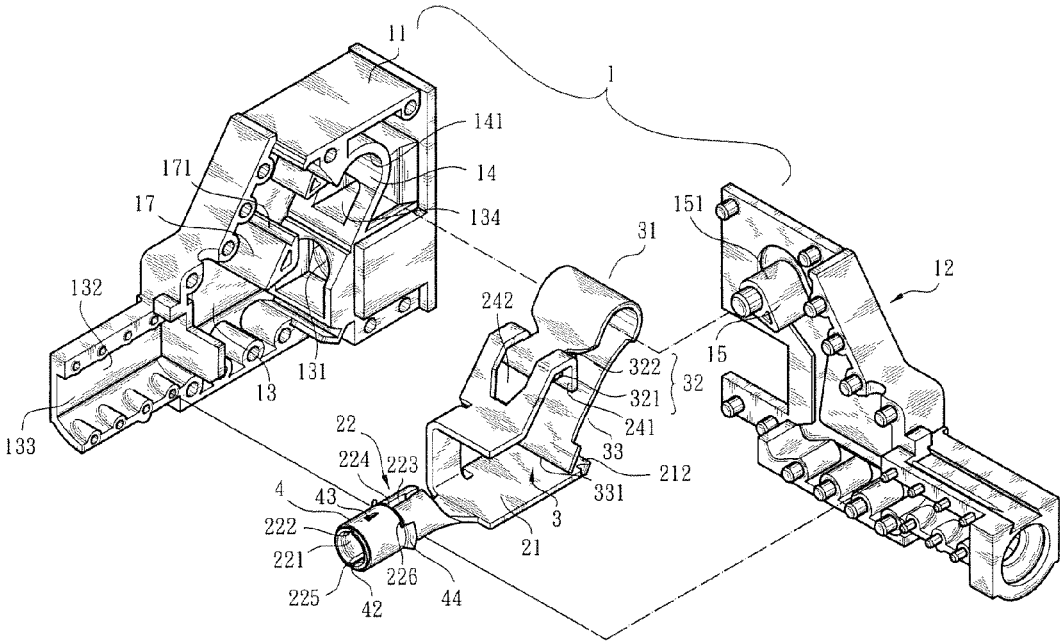
FIG. 2 is a perspective partially assembled view of the first embodiment of the present invention.
Figure 3:
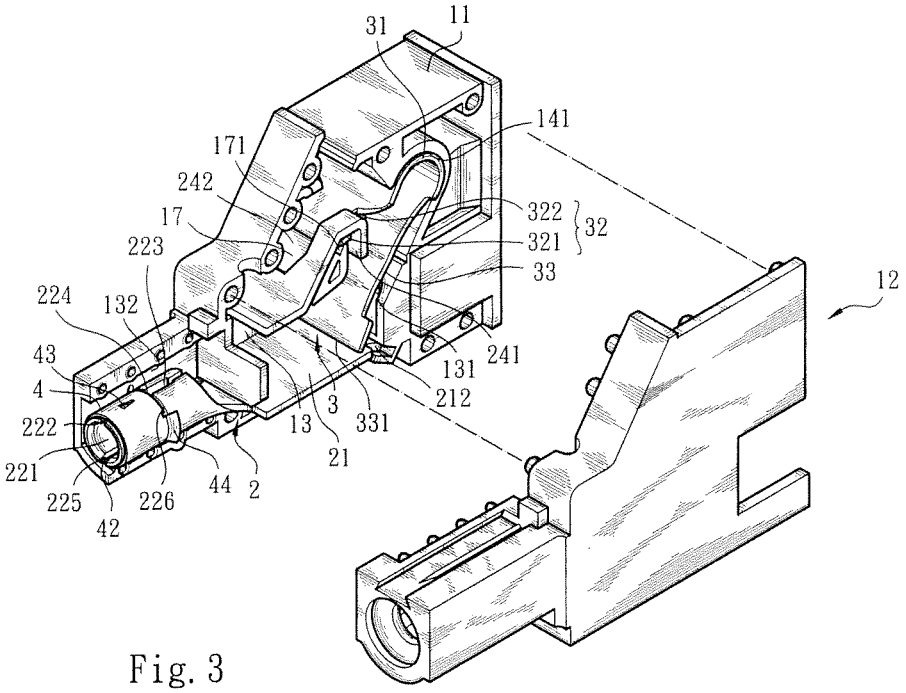
FIG. 3 is also a perspective partially assembled view of the first embodiment of the present invention.
Figure 4:
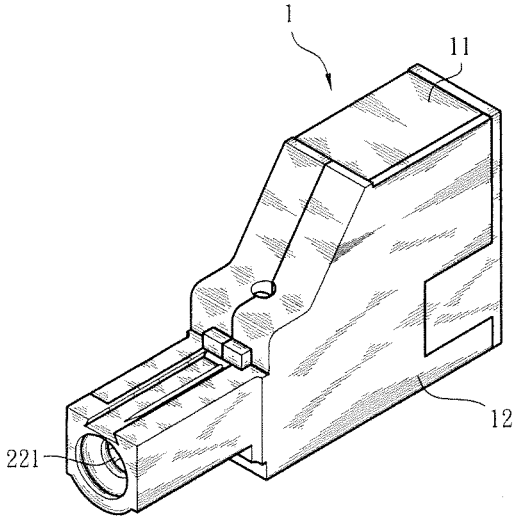
FIG. 4 is a perspective assembled view of the first embodiment of the present invention.

Please refer to FIGS. 1 to 5. The plug-in wire connection terminal structure of the present invention includes a main body 1, a holding plate 2, a leaf spring 3 and a collar member 4. The main body 1 is composed of an insulation casing 11 and an insulation cover 12 mated with the insulation casing 11. The insulation casing 11 has an internal receiving space 13. The lateral sides of the receiving space 13 are respectively formed with a wire inlet 131 in communication with outer side, a channel 132 and a side section 14 having an arched inner face 141. The channel 132 communicates with the outer side via an opening 133. A stopper block 17 is disposed between the side section 14 and the receiving space 13. One side of the stopper block 17, which side faces the side section 14, is recessed to form a locating section 171. In addition, a shift perforation 134 in communication with the outer side is disposed between the side section 14 and the wire inlet 131. A middle protrusion block 15 is disposed on the insulation cover 12 in a position corresponding to the interior of the side section 14. The middle protrusion block 15 has an arched outer face 151 corresponding to the arched inner face 141. After the insulation cover 12 is mated with the insulation casing 11, an arched guide slot 16 is defined between the arched inner face 141 and the arched outer face 151.

The holding plate 2 has a receiving section 21 in the middle. The receiving section 21 is positioned in the receiving space 13 of the main body 1. The lateral sides of the receiving section 21 are respectively formed with a wire entrance 211 corresponding to the wire inlet 131 and a conductive contact section 22 received in the channel 132. The conductive contact section 22 is formed with a socket 221 in a position corresponding to the opening 133. A fitting section 227 is disposed at one end of the conductive contact section 22, which end is distal from the receiving section 21. The fitting section 227 extends from outer circumference of the end of the conductive contact section 22 in a direction away from the middle of the holding plate 2. The fitting section 227 has an outer diameter smaller than that of the other part of the conductive contact section 22. An annular stopper flange 226 is disposed at one end of the fitting section 227, which end is proximal to the receiving section 21. The annular wall of the conductive contact section 22 is further formed with at least one split 225 in communication with the outer side and a slit 222. A middle section of the slit 222 (or the split 225) is formed with an expansion fissure 223 with a larger gap. In addition, a shoulder section 224 is formed at the junction between the expansion fissure 223 and the slit 222 (or the split 225). The lateral side of the receiving section 21 of the holding plate 2 is connected with a connection section 24 directed to the arched guide slot 16. The connection section 24 is a bent hook section 241 formed with a receiving hollow 242. A plane support section 243 outward extends from a lateral side of the receiving hollow 242, which lateral side is proximal to the hook section 241. In addition, one side of the wire entrance 211 of the receiving section 21 opposite to the connection section 24 is formed with an outward biased guide edge 212. A wire 6 can be passed through the wire inlet 131 to extend into the wire entrance 211. Therefore, the guide edge 212 serves to guide the wire 6 into the receiving section 21.

The leaf spring 3 has a bight section 31 in the middle. The bight section 31 is received in the arched guide slot 16 of the main body 1. A connected section 32 is disposed at one end of the bight section 31. The connected section 32 has two protruding abutment sections 321 formed on two sides of the end section. A neck section 322 is formed between the abutment sections 321 and the bight section 31. The neck section 322 has a width smaller than that of the receiving hollow 242. The abutment sections 321 are extended into the receiving hollow 242 of the holding plate 2 and stopped by the hook section 241. An end face of the connected section 32 is inlaid in the locating section 171, whereby the holding plate 2 and the leaf spring 3 are securely connected with each other without easy detachment. The neck section 322 is rested on the support section 243, which restricts the connected section 32 from clockwise loosening. Moreover, the bight section 31 of the leaf spring 3 is prevented from rotating or sliding within the arched guide slot 16. Also, an abutment end 331 is connected with the other end of the bight section 31 via an oblique elastic arm 33. The oblique elastic arm 33 can pass through one side of the shift perforation 134 to obliquely extend toward the receiving section 21. The oblique elastic arm 33 has such a length that the abutment end 331 is just kept in the receiving section 21 inside the guide edge 212. The guide edge 212 is outward biased so as to ensure that the abutment end 331 can enter the receiving section 21 in an insertion direction of the conductor section 61 of the wire 6 without being stopped outside. The bight section 31 is prevented from rotating or sliding within the arched guide slot 16 so that the oblique elastic arm 33 can be positioned in its true position. In this case, the positional relationship between the abutment end 331, the receiving section 21 and the guide edge 212 can keep stable.

In this embodiment, the collar member 4 is a hollow tubular body with good rigidity and elasticity. The collar member 4 has a collar section 41 corresponding to the fitting section 227. The annular wall of the collar section 41 is formed with at least one slit 42 in communication with the outer side. In addition, at least one locating section 43 is disposed on inner circumference of the collar member 4. The locating section 43 protrudes from the inner circumference of the collar member 4 toward the conductive contact section 22. One end of the locating section 43 is formed with a tapered section 431. In addition, multiple outward expanded push sections 44 extend from the circumference of one end of the collar member 4.

When assembled, the connected section 32 of the leaf spring 3 is connected with the connection section 24 of the holding plate 2. Then the holding plate 2 is placed into the receiving space 13 of the main body 1 with the bight section 31 of the leaf spring 3 positioned in the arched guide slot 16. Also, the conductive contact section 22 is positioned in the channel 132 with the socket 221 aligned with the opening 133. Under the help of the push sections 44, the collar member 4 is fitted onto the outer circumference of the fitting section 227 from the end of the conductive contact section 22, which end is distal from the receiving section 21. The end of the locating section 43 with the tapered section 431 is slid along the slit 222 (or the split 225). On one hand, the push sections 44 facilitate forcedly pushing the collar member 4. On the other hand, when the push sections 44 are pushed to the position of the stopper flange 226, the collar member 4 is stopped from sliding. Moreover, at this time, the push sections 44 are in oblique contact with the stopper flange 226 so that a slight reaction push force is created. Under such circumstance, when the locating section 43 is engaged with the shoulder section 224, under the reaction push force, the locating section 43 is axially double engaged between the stopper flange 226 and the shoulder section 224. In this case, axial loosening between the connected collar member 4 and the conductive contact section 22 (the fitting section 227) can be eliminated. Therefore, during the plugging/unplugging process, the collar member 4 is prevented from loosening. The collar member 4 is made of a material with very good rigidity so that the collar member 4 with the slit 42 has excellent elasticity. This can enhance the elastic holding effect of the socket 221.

Figure 5:
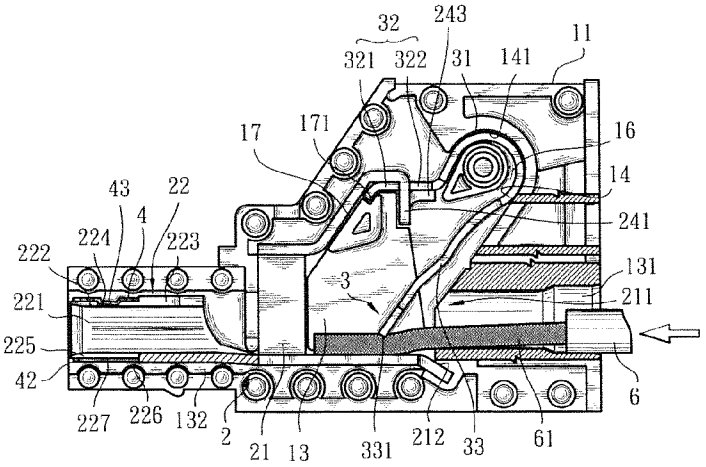
FIG. 5 is a sectional assembled view of the first embodiment of the present invention, showing that a wire is inserted into the terminal of the present invention.
Figure 6:
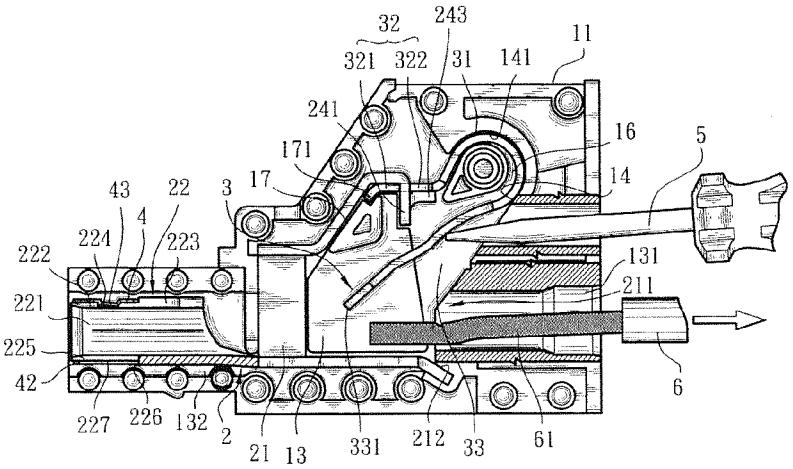
FIG. 6 is a sectional assembled view according to FIG. 5, showing that a tool is extended into the terminal to release the wire.
Figure 7:
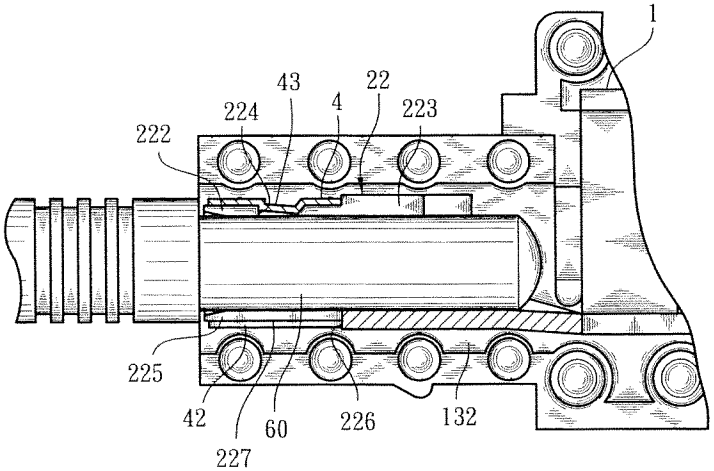
FIG. 7 is a sectional view showing that a plug member is plugged into the conductive contact section of the present invention.

Please now refer to FIGS. 5 to 7. In use of the present invention, the conductor section 61 of the stripped wire 6 is passed through the wire inlet 131 and the wire entrance 211 to push the oblique elastic arm 33 of the leaf spring 3. At this time, the oblique elastic arm 33 is elastically biased, whereby the conductor section 61 can continuously extend into the receiving section 21 of the holding plate 2. The oblique elastic arm 33 serves to abut against the conductor section 61 to provide a resistance for the conductor section 61 against reverse pullout of the conductor section 61. Under such circumstance, the wire 6 is prevented from outward loosening after assembled. A tool 5 (such as a screwdriver) can be extended into the shift perforation 134 to push and deflect the oblique elastic arm 33 so as to release the conductor section 61. At this time, the wire 6 can be outward extracted. A pin-shaped conductive plug member 60 can be plugged into the socket 221 of the holding plate 2. By means of the good rigidity and elasticity of the collar member 4, a greater elastic holding force is applied to the conductive contact section 22 (the fitting section 227), whereby the conductive contact section 22 is in good contact with the plug member 60.

In practice, the holding plate 2 is the major conductive component for mating with the plug member. Therefore, the holding plate 2 is made of high-conductivity material. In addition, the holding plate 2 is coated with a silver coating with highest conductivity for more stabilizing the current. The other components such as the leaf spring 3 are made of stainless steel 301 by means of vacuum stereotyping to enhance the stability of elasticity and minimize the possibility of oxidization. Also, the holding plate 2 and the leaf spring 3 have highly simplified configuration and structure.

Only little material needs to be cut off and few parts need to be processed. Therefore, the processing and material costs are lowered. Moreover, the leaf spring 3 and the holding plate 2 can be easily assembled by means of very simple steps so that the assembling cost is also lowered. Especially, the difficulty in bending process is greatly reduced so that the possibility of breakage is minimized.

Figure 8:
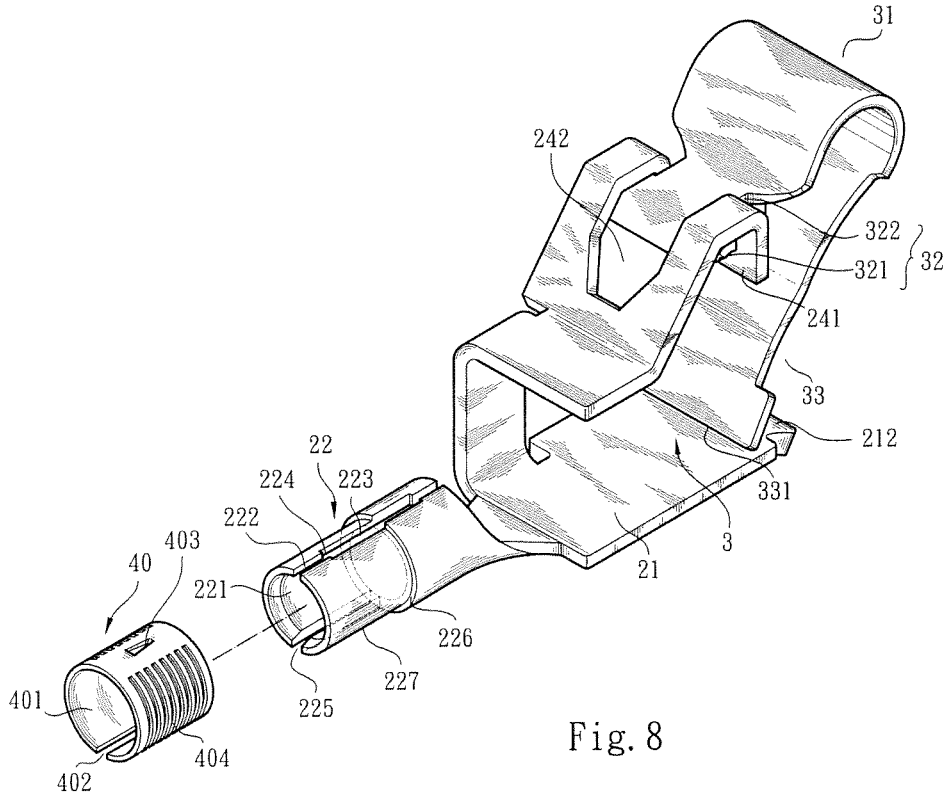
FIG. 8 is a perspective exploded view of a second embodiment of the present invention.

Please now refer to FIG. 8, which is a perspective exploded view of a second embodiment of the present invention. According to this embodiment, the plug-in wire connection terminal structure of the present invention includes a main body 1, a holding plate 2 and a leaf spring 3, which are identical to those of the first embodiment. The second embodiment further includes a collar member 40 also having a collar section 401. The annular wall of the collar section 401 is formed with at least one slit 402 in communication with the outer side. In addition, at least one locating section 403 is disposed on inner circumference of the collar member 40. The locating section 403 protrudes from the inner circumference of the collar member 40. In addition, multiple raised/recessed stripes 404 are formed on outer circumference of the collar member 40. When assembled, the stripes 404 provide the frictional force necessary for the operation, whereby the collar member 40 can be easily pushed to assemble with the conductive contact section 22 (the fitting section 227). The connection relationship between the other parts of the collar member 40 and the holding plate 2 of the second embodiment is identical to that of the first embodiment. Also, the connection relationship between the main body 1, the holding plate 2 and the leaf spring 3 is identical to that of the first embodiment and thus will not be repeatedly described hereinafter.

In conclusion, the plug-in wire connection terminal structure of the present invention has simplified components and structure and is easy to assemble. Moreover, the plug-in wire connection terminal structure of the present invention is able to provide excellent elastic holding effect.

The above embodiments are only used to illustrate the present invention, not intended to limit the scope thereof. Many modifications of the above embodiments can be made without departing from the spirit of the present invention.

What is claimed is:

1. A plug-in wire connection terminal structure comprising:

a main body having an internal receiving space, lateral sides of the receiving space being respectively formed with an arched guide slot in communication with the receiving space and a stopper block;

a holding plate having a receiving section in a middle thereof, the receiving section being positioned in the receiving space of the main body, lateral sides of the receiving section being respectively formed with a wire entrance and a conductive contact section in which an external member can be conductively plugged, a connection section being formed on the receiving section, the connection section extending outwardly and toward the arched guide slot, extending to the arched guide slot, the conductive contact section extending from the holding plate, the conductive contact section being formed with a socket, the main body being formed with a channel at one end thereof for receiving the conductive contact section and a wire inlet at another end thereof corresponding to the wire entrance, the channel having an opening in communication with an outer side of the main body; and a leaf spring having a curved bight section in a middle thereof, the bight section being received in the arched guide slot of the main body, a connected section being formed at one end of the bight section, the connected section being latched with the connection section of the holding plate, the stopper block being cooperatively engaged with the connected section, whereby the holding plate and the leaf spring are securely connected with each other without easy detachment, an abutment end being disposed at the other end of the bight section, when the leaf spring is assembled with the main body, the abutment end obliquely extending from the wire entrance of the holding plate to the receiving section, the abutment end having such a length that the abutment end is just engaged in the receiving section inside a guide edge.

2. The plug-in wire connection terminal structure as claimed in claim 1, wherein the connection section is detachably hooked with the connected section.

3. The plug-in wire connection terminal structure as claimed in claim 2, wherein the stopper block is formed with a locating section corresponding to the end of the connected section, whereby the end of the connected section is held between the hook section and the locating section to securely assemble the connected section with the hook section without easy detachment.

4. The plug-in wire connection terminal structure as claimed in claim 2, wherein a neck section is formed between the bight section and the abutment sections of the leaf spring, the neck section having a width smaller than that of the receiving hollow, a support section outward extending from a lateral side of the receiving hollow, the support section being positioned in a position corresponding to the neck section.

5. The plug-in wire connection terminal structure as claimed in claim 2, wherein the connection section is formed as a hook section, the hook section being formed with a receiving hollow, the connected section having two protruding abutment sections laterally protruding from two sides of the connected section, the abutment sections extending into the receiving hollow and being latched with two sides of the receiving hollow, whereby the connected section is securely connected with the hook section without easy detachment.

6. The plug-in wire connection terminal structure as claimed in claim 2, wherein an annular wall of the socket being formed with at least one slit, a fitting section being disposed at one end of the conductive contact section, which end is distal from the receiving section, the fitting section extending from outer circumference of the end of the conductive contact section, a collar section of a collar member being correspondingly fitted on the fitting section and secured to the fitting section.

7. The plug-in wire connection terminal structure as claimed in claim 6, wherein the shoulder section is disposed at the middle section of the slit of the conductive contact section.

8. The plug-in wire connection terminal structure as claimed in claim 6, wherein the middle section of the slit of the conductive contact section is formed with an expansion fissure with a larger width, the shoulder section being formed at a junction between the slit and the expansion fissure, one end of the locating section being formed with a tapered section.

9. The plug-in wire connection terminal structure as claimed in claim 1, wherein an annular wall of the socket being formed with at least one slit, a fitting section being disposed at one end of the conductive contact section, which end is distal from the receiving section, the fitting section extending from outer circumference of the end of the conductive contact section, a collar section of a collar member being correspondingly fitted on the fitting section and secured to the fitting section.

10. The plug-in wire connection terminal structure as claimed in claim 9, wherein at least one locating section is disposed on one of the collar member and the conductive contact section, the locating section protruding from a surface of one of the collar member and the conductive contact section, a shoulder section being disposed on the other of the collar member and the conductive contact section corresponding to the locating seat ion, whereby the locating section can be fixedly engaged with the shoulder section.

11. The plug-in wire connection terminal structure as claimed in claim 9, wherein an annular wall of the collar section is formed with at least one slit in communication with outer side.

12. The plug-in wire connection terminal structure as claimed in claim 9, wherein an annular stopper flange is disposed at one end of the fitting section, which end is proximal to the receiving section.

13. The plug-in wire connection terminal structure as claimed in claim 12, wherein the annular wall of the conductive contact section is formed with at least one split, the split extending from one end of the conductive contact section, which end is distal from the receiving section, to the stopper flange.

14. The plug-in wire connection terminal structure as claimed in claim 9, wherein at least one outward expanded push section extends from a circumference of one end of the collar member.

15. The plug-in wire connection terminal structure as claimed in claim 9, wherein multiple stripes are formed on outer circumference of the collar member for increasing frictional force.

16. The plug-in wire connection terminal structure as claimed in claim 1, wherein the arched guide slot is defined between a middle protrusion block and a side section disposed on outer side of the middle protrusion block.

17. The plug-in wire connection terminal structure as claimed in claim 2, wherein the arched guide slot is defined between a middle protrusion block and a side section disposed on outer side of the middle protrusion block.

18. The plug-in wire connection terminal structure as claimed in claim 9, wherein the arched guide slot is defined between a middle protrusion block and a side section disposed on outer side of the middle protrusion block.

19. The plug-in wire connection terminal structure as claimed in claim 16, wherein the middle protrusion block at least partially has an arched outer face and the side section at least partially has an arched inner face corresponding to the arched outer face of the middle protrusion block.

20. The plug-in wire connection terminal structure as claimed in claim 17, wherein the middle protrusion block at least partially has an arched outer face and the side section at least partially has an arched inner face corresponding to the arched outer face of the middle protrusion block.

21. The plug-in wire connection terminal structure as claimed in claim 1, wherein an oblique elastic arm is disposed between the bight section and the abutment end of the leaf spring, the main body being formed with a shift perforation corresponding to a middle section of the oblique elastic arm.

22. The plug-in wire connection terminal structure as claimed in claim 2, wherein an oblique elastic arm is disposed between the bight section and the abutment end of the leaf spring, the main body being formed with a shift perforation corresponding to a middle section of the oblique elastic arm.

23. The plug-in wire connection terminal structure as claimed in claim 9, wherein an oblique elastic arm is disposed between the bight section and the abutment end of the leaf spring, the main body being formed with a shift perforation corresponding to a middle section of the oblique elastic arm.

24. The plug-in wire connection terminal structure as claimed in claim 17, wherein an oblique elastic arm is disposed between the bight section and the abutment end of the leaf spring, the main body being formed with a shift perforation corresponding to a middle section of the oblique elastic arm.

25. The plug-in wire connection terminal structure as claimed in claim 1, wherein one side of the wire entrance, which side is distal from the connection section, is formed with an outward biased guide edge, whereby a wire extended into the wire entrance can be guided by the guide edge into the receiving section.

26. The plug-in wire connection terminal structure as claimed in claim 2, wherein one side of the wire entrance, which side is distal from the connection section, is formed with an outward biased guide edge, whereby a wire extended into the wire entrance can be guided by the guide edge into the receiving section.

27. The plug-in wire connection terminal structure as claimed in claim 1, wherein the main body is composed of an insulation casing and an insulation cover mated with the insulation casing.

28. The plug-in wire connection terminal structure as claimed in claim 2, wherein the main body is composed of an insulation casing and an insulation cover mated with the insulation casing.

* * * * *